US011322164B2

(12) United States Patent
Kjoerling et al.

(10) Patent No.: US 11,322,164 B2
(45) Date of Patent: May 3, 2022

(54) METHODS AND DEVICES FOR CODING SOUNDFIELD REPRESENTATION SIGNALS

(71) Applicants: DOLBY INTERNATIONAL AB, Amsterdam Zuidoost (NL); DOLBY LABORATORIES LICENSING CORPORATION, San Francisco, CA (US)

(72) Inventors: Kristofer Kjoerling, Solna (SE); David S. McGrath, Rose Bay (AU); Heiko Purnhagen, Sundbyberg (SE); Mark R. P. Thomas, Walnut Creek, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 16/963,489

(22) PCT Filed: Jan. 17, 2019

(86) PCT No.: PCT/US2019/014090
§ 371 (c)(1),
(2) Date: Jul. 20, 2020

(87) PCT Pub. No.: WO2019/143867
PCT Pub. Date: Jul. 25, 2019

(65) Prior Publication Data

US 2021/0050022 A1 Feb. 18, 2021

Related U.S. Application Data

(60) Provisional application No. 62/618,991, filed on Jan. 18, 2018.

(51) Int. Cl.
*G10L 19/008* (2013.01)

(52) U.S. Cl.
CPC ..... *G10L 19/008* (2013.01)

(58) Field of Classification Search
CPC ..... G10L 19/00; G10L 19/20; G10L 19/008; H04S 3/02; H04S 2420/11
(Continued)

(56) References Cited

U.S. PATENT DOCUMENTS 9,774,975 B2 9/2017 Krueger
9,838,822 B2 12/2017 Boehm
(Continued)

FOREIGN PATENT DOCUMENTS

JP 2015529850 10/2015
JP 2015531078 10/2015
(Continued)

OTHER PUBLICATIONS

ETSI TS 103 190-2 "Digital Audio Compression (AC-4) Standard Part 2: Immersive and Personalized Audio" 103 190-2 V1.3.1 (Oct. 2017).
(Continued)

*Primary Examiner* — Leshui Zhang

(57) ABSTRACT

The present document describes a method (400) for encoding a soundfield representation (SR) input signal (101, 301) describing a soundfield at a reference position, wherein the SR input signal (101, 301) comprises a plurality of channels for a plurality of different directivity patterns of the soundfield at the reference position. The method (400) comprises extracting (401) one or more audio objects (103, 303) from the SR input signal (101, 301). Furthermore, the method (400) comprises determining (402) a residual signal (102, 302) based on the SR input signal (101, 301) and based on the one or more audio objects (103, 303). The method (400) also comprises performing joint coding of the one or more audio objects (103, 303) and/or the residual signal (102,
(Continued)

302). In addition, the method (400) comprises generating (403) a bitstream (701) based on data generated in the context of joint coding of the one or more audio objects (103, 303) and/or the residual signal (102, 302).

21 Claims, 2 Drawing Sheets

(58) Field of Classification Search
USPC ..... 704/500–504; 381/1–23; 700/94
See application file for complete search history.

(56) References Cited

U.S. PATENT DOCUMENTS 9,854,375 B2 12/2017 Stockhammer
2009/0171676 A1* 7/2009 Oh ..... G10L 19/008 704/500
2009/0299742 A1* 12/2009 Toman ..... G10L 21/0208 704/233
2010/0228554 A1* 9/2010 Beack ..... G10L 19/008 704/500
2010/0332239 A1* 12/2010 Kim ..... G10L 19/0017 704/500
2012/0070007 A1* 3/2012 Kim ..... H04S 3/008 381/22
2012/0114126 A1* 5/2012 Thiergart ..... G10L 21/0272 381/17
2012/0177204 A1* 7/2012 Hellmuth ..... G10L 19/008 381/22
2014/0297296 A1* 10/2014 Koppens ..... G10L 19/008 704/500
2014/0350944 A1* 11/2014 Jot ..... G10L 19/008 704/500
2014/0358567 A1* 12/2014 Koppens ..... H04R 3/12 704/500
2015/0162012 A1* 6/2015 Kastner ..... G10L 19/008 704/500
2015/0194158 A1* 7/2015 Oh ..... G10L 19/008 381/22
2015/0269951 A1* 9/2015 Kalker ..... G10L 19/20 704/500
2015/0356978 A1* 12/2015 Dickins ..... G10L 19/0208 704/226
2016/0111099 A1* 4/2016 Hirvonen ..... G10L 25/06 381/22
2016/0150343 A1* 5/2016 Wang ..... G10L 19/20 381/103
2016/0255454 A1 9/2016 McGrath
2017/0156015 A1* 6/2017 Stockhammer .... H04N 21/8456
2017/0171576 A1 6/2017 Oh
2017/0215019 A1* 7/2017 Chen ..... G10L 21/0308
2018/0090151 A1* 3/2018 Dick ..... H04S 3/008

FOREIGN PATENT DOCUMENTS

JP 2016525715 8/2016
JP 2016530788 9/2016
JP 2017515164 6/2017
WO 2016142375 3/2015
WO 2017140666 8/2017

OTHER PUBLICATIONS

ETSI TS 103 420 V1.1.1, Jul. 2016 "Backwards-Compatible Object Audio Carriage Using Enhanced AC-3".
Sen, D. et al. "Efficient Compression and Transportation of Scene-Based Audio for Television Broadcast" Jul. 14, 2016, AES International Conference, pp. 1-8.
Setiawan, P. et al. "Compressing Higher Order Ambisonics of a Multizone Soundfield" published in Acoustics, Speech and Signal Processing Mar. 2017.
Sound Labs, "3D Audio Formats for Virtual Reality" Jun. 29, 2016.
Villemoes, L. et al. "Decorrelation for Audio Object Coding" IEEE published in Acoustics, Speech and Signal Processing, Mar. 2017, pp. 706-709.

* cited by examiner

METHODS AND DEVICES FOR CODING SOUNDFIELD REPRESENTATION SIGNALS

CROSS-REFERENCE TO RELATED APPLICATIONS

This patent application is the U.S. National Stage of International Patent Application No. PCT/US2019/014090 filed Jan. 17, 2019, which claims the benefit of priority from U.S. Provisional Patent Application No. 62/618,991, filed on 18 Jan. 2018, which is incorporated by reference in its entirety.

TECHNICAL FIELD

The present document relates to soundfield representation signals, notably ambisonics signals. In particular, the present document relates to the coding of soundfield representation signals using an object-based audio coding scheme such as AC-4.

BACKGROUND

The sound or soundfield within the listening environment of a listener that is placed at a listening position may be described using an ambisonics signal. The ambisonics signal may be viewed as a multi-channel audio signal, with each channel corresponding to a particular directivity pattern of the soundfield at the listening position of the listener. An ambisonics signal may be described using a three-dimensional (3D) cartesian coordinate system, with the origin of the coordinate system corresponding to the listening position, the x-axis pointing to the front, the y-axis pointing to the left and the z-axis pointing up.

By increasing the number of audio signals or channels and by increasing the number of corresponding directivity patterns (and corresponding panning functions), the precision with which a soundfield is described may be increased. By way of example, a first order ambisonics signal comprises 4 channels or waveforms, namely a W channel indicating an omnidirectional component of the soundfield, an X channel describing the soundfield with a dipole directivity pattern corresponding to the x-axis, a Y channel describing the soundfield with a dipole directivity pattern corresponding to the y-axis, and a Z channel describing the soundfield with a dipole directivity pattern corresponding to the z-axis. A second order ambisonics signal comprises 9 channels including the 4 channels of the first order ambisonics signal (also referred to as the B-format) plus 5 additional channels for different directivity patterns. In general, an L-order ambisonics signal comprises $(L+1)^2$ channels including the $L^2$ channels of the (L−1)-order ambisonics signals plus $[(L+1)^2-L^2]$ additional channels for additional directivity patterns (when using a 3D ambisonics format). L-order ambisonics signals for L>1 may be referred to as higher order ambisonics (HOA) signals.

An HOA signal may be used to describe a 3D soundfield independently from an arrangement of speakers, which is used for rendering the HOA signal. Example arrangements of speakers comprise headphones or one or more arrangements of loudspeakers or a virtual reality rendering environment. Hence, it may be beneficial to provide an HOA signal to an audio render, in order to allow the audio render to flexibly adapt to different arrangements of speakers.

The present document addresses the technical problem of transmitting HOA signals, or more generally soundfield representation (SR) signals, over a transmission network with high perceptual quality in a bandwidth efficient manner. The technical problem is solved by the independent claims. Preferred examples are described in the dependent claims.

SUMMARY

According to an aspect, a method for encoding a soundfield representation (SR) input signal which represents a soundfield at a reference position is described. The method comprises extracting one or more audio objects from the SR input signal. Furthermore, the method comprises determining a residual signal based on the SR input signal and based on the one or more audio objects. The method also comprises performing joint coding of the one or more audio objects and/or the residual signal. In addition, the method comprises generating a bitstream based on data generated in the context of joint coding of the one or more audio objects and/or the residual signal.

According to a further aspect, a method for decoding a bitstream indicative of a SR input signal which represents a soundfield at a reference position is described. The method comprises deriving one or more reconstructed audio objects from the bitstream. Furthermore, the method comprises deriving a reconstructed residual signal from the bitstream. In addition, the method comprises deriving SR metadata indicative of a format and/or a number of channels of the SR input signal from the bitstream.

According to a further aspect, an encoding device (or apparatus) configured to encode a SR input signal which is indicative of a soundfield at a reference position is described. The encoding device is configured to extract one or more audio objects from the SR input signal. Furthermore, the encoding device is configured to determine a residual signal based on the SR input signal and based on the one or more audio objects. In addition, the encoding device is configured to generate a bitstream based on the one or more audio objects and based on the residual signal.

According to another aspect, a decoding device (or apparatus) configured to decode a bitstream indicative of a SR input signal which represents a soundfield at a reference position is described. The decoding device is configured to derive one or more reconstructed audio objects from the bitstream. Furthermore, the decoding device is configured to derive a reconstructed residual signal from the bitstream. In addition, the decoding device is configured to derive SR metadata indicative of a format and/or of a number of channels of the SR input signal from the bitstream.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods, devices and systems including its preferred embodiments as outlined in the present patent application may be used stand-alone or in combination with the other methods, devices and systems disclosed in this document. Furthermore, all aspects of the methods, devices and systems outlined in the present patent application may be arbitrarily combined. In particular, the features of the claims may be combined with one another in an arbitrary manner.

SHORT DESCRIPTION OF THE FIGURES

The invention is explained below in an exemplary manner with reference to the accompanying drawings, wherein FIG. 1 shows an example encoding unit for encoding a soundfield representation signal;

Figure 6A:
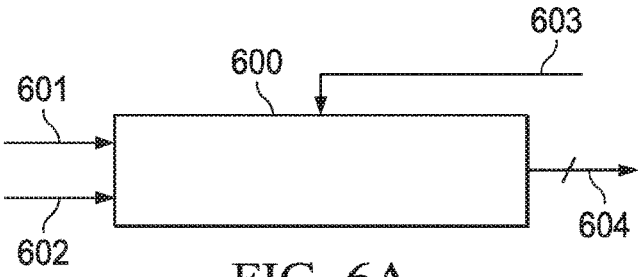
Figure 6B:
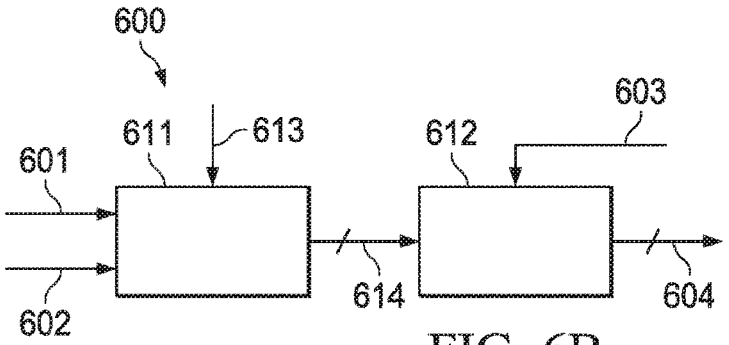

FIGS. 6*a* and 6*b* show example audio renders; and

Figure 7:
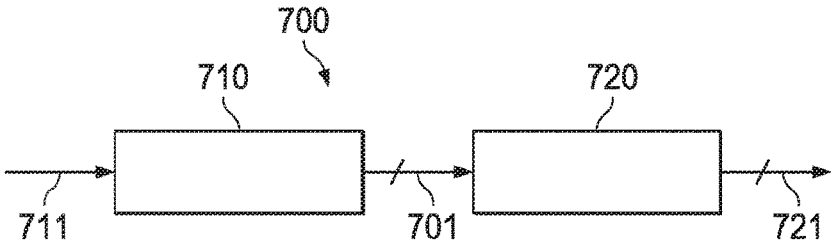

FIG. 7 shows an example coding system.

DETAILED DESCRIPTION

As outlined above, the present document relates to an efficient coding of HOA signals which are referred to herein more generally as soundfield representation (SR) signals. Furthermore, the present document relates to the transmission of an SR signal over a transmission network within a bitstream. In a preferred example, an SR signal is encoded and decoded using an encoding/decoding system which is used for audio objects, such as the AC-4 codec system standardized in ETSI (TS 103 190 and TS 103 190-2).

As outlined in the introductory section, an SR signal may comprise a relatively high number of channels or waveforms, wherein the different channels relate to different panning functions and/or to different directivity patterns. By way of example, an $L^{th}$-order 3D HOA signal comprises $(L+1)^2$ channels. An SR signal may be represented in various different formats. An example format is the so called Bee-Hive format (abbreviated as the BH format) which is described e.g. in US 2016/0255454 A1, wherein this document is incorporated herein by reference.

A soundfield may be viewed as being composed of one or more sonic events emanating from arbitrary directions around the listening position. By consequence the locations of the one or more sonic events may be defined on the surface of a sphere (with the listening or reference position being at the center of the sphere).

A soundfield format such as Higher Order Ambisonics (HOA) is defined in a way to allow the soundfield to be rendered over arbitrary speaker arrangements (i.e. arbitrary rendering systems). However, rendering systems (such as the Dolby Atmos system) are typically constrained in the sense that the possible elevations of the speakers are fixed to a defined number of planes (e.g. an ear-height (horizontal) plane, a ceiling or upper plane and/or a floor or lower plane). Hence, the notion of an ideal spherical soundfield may be modified to a soundfield which is composed of sonic objects that are located in different rings at various heights on the surface of a sphere (similar to the stacked-rings that make up a beehive).

An example arrangement with four rings may comprise a middle ring (or layer), an upper ring (or layer), a lower ring (or layer) and a zenith ring (being a single point at the zenith of the sphere). This format may be referred to as the BHa.b.c.d format, wherein "a" indicates the number of channels on the middle ring, "b" the number of channels on the upper ring, "c" the number of channels on the lower ring, and "d" the number of channels at the zenith (wherein "d" only takes on the values "0" or "1"). The channels may be uniformly distributed on the respective rings. Each channel corresponds to a particular directivity pattern. By way of example, a BH3.1.0.0 format may be used to describe a soundfield according to the B-format, i.e. a BH3.1.0.0 format may be used to describe a first order ambisonics signal.

An object-based audio renderer may be configured to render an audio object using a particular arrangement of speakers. FIG. 6*a* shows an example audio render 600 which is configured to render an audio object, wherein the audio object comprises an audio object signal 601 (comprising the actual, monophonic, audio signal) and object metadata 602 (describing the position of the audio object as a function of time). The audio renderer 600 makes use of speaker position data 603 indicating the positions of the N speakers of the speaker arrangement. Based on this information, the audio renderer 600 generates N speaker signals 604 for the N speakers. In particular, the speaker signal 604 for a speaker may be generated using a panning gain, wherein the panning gain depends on the (time-invariant) speaker position (indicated by the speaker position data 603) and on the (time-variant) object metadata 602 which indicates the object location within the 2D or 3D rendering environment.

As shown in FIG. 6*b*, the audio rendering of an audio object may be split up into two steps, a first (time-variant) step 611 which pans the audio object into intermediate speaker signals 614, and a second (time-invariant) step 612 which transforms the intermediate speaker signals 614 into the speaker signals 604 for the N speakers of the particular speaker arrangement. For the first step 611, an intermediate speaker arrangement 613 with K intermediate speakers may be assumed (e.g. K>11 such as K=14). The K intermediate speakers may be located on one or more different rings of a beehive or sphere (as outlined above). In other words, the K intermediate speaker signals 614 for the K intermediate speakers may correspond to the different channels of an SR signal which is represented in the BH format. This intermediate format may be referred to as an Intermediate Spatial Format (ISF), as defined e.g. in the Dolby Atmos technology.

An audio renderer 600 may be configured to render one or more static objects, i.e. objects which exhibit a fixed and/or time-invariant object location. Static objects may also be referred to as an object bed, and may be used to reproduce ambient sound. The one or more static objects may be assigned to one or more particular speakers of a speaker arrangement. By way of example, an audio renderer 600 may allow for three different speaker planes (or rings), e.g. a horizontal plane, an upper plane and a lower plane (as is the case for the Dolby Atmos technology). In each plane, a multi-channel audio signal may be rendered, wherein each channel may correspond to a static object and/or to a speaker within the plane. By way of example, the horizontal plane may allow rendering of a 5.1 or 4.0 or 4.x multi-channel audio signal, wherein the first number indicates the number of speaker channels (such as Front Left, Front Right, Front Center, Rear Left, and/or Rear Right) and the second number indicates the number of LFE (low frequency effects) channels. The upper plane and/or the lower plane may e.g. allow the use of 2 channels each (e.g. Front Left and/or Front Right). Hence, a bed of fixed audio objects may be defined, using e.g. the notation 4.x.2.2., wherein the first two numbers indicate the number of channels of the horizontal plane (e.g. 4.x), wherein the third number indicates the number of channels of the upper plane (e.g. 2), and wherein the fourth number indicates the number of channels of the lower plane (e.g. 2).

As shown in FIG. 7, an object-based audio coding system 700 such as AC-4 comprises an encoding unit 710 and a decoding unit 720. The encoding unit 710 may be configured to generate a bitstream 701 for transmission to the decoding unit 720 based on an input signal 711, wherein the input signal 711 may comprise a plurality of objects (each object comprising an object signal 601 and object metadata 602). The plurality of objects may be encoded using a joint object coding scheme (JOC), notably Advanced JOC (A-JOC) used in AC-4.

The Joint Object Coding tool and notably the A-JOC tool enables an efficient representation of object-based immersive audio content at reduced data rates. This is achieved by conveying a multi-channel downmix of the immersive content (i.e. of the plurality of audio objects) together with parametric side information that enables the reconstruction of the audio objects from the downmix signal at the decoder 720. The multi-channel downmix signal may be encoded using waveform coding tools such as ASF (audio spectral front-end) and/or A-SPX (advanced spectral extension), thereby providing waveform coded data which represents the downmix signal. Particular examples for an encoding scheme for encoding the downmix signal are MPEG AAC, MPEG HE-AAC and other MPEG Audio codecs, 3GPP EVS and other 3GPP codecs, and Dolby Digital/Dolby Digital Plus (AC-3, eAC-3).

The parametric side information comprises JOC parameters and the object metadata 602. The JOC parameters primarily convey the time- and/or frequency-varying elements of an upmix matrix that reconstructs the audio objects from the downmix signal. The upmix process may be carried out in the QMF (Quadrature Mirror Filter) subband domain. Alternatively, another time/frequency transform, notably a FFT (Fast Fourier Transform)-based transform, may be used to perform the upmix process. In general, a transform may be applied, which enables a frequency-selective analysis and (upmix-) processing. The JOC upmix process, notably the A-JOC upmix process, may also include decorrelators that enable an improved reconstruction of the covariance of the plurality of objects, wherein the decorrelators may be controlled by additional JOC parameters. Hence, the encoder 710 may be configured to generate a downmix signal plus JOC parameters (in addition to the object metadata 602). This information may be included into the bitstream 701, in order to enable the decoder 720 to generate a plurality of reconstructed objects as an output signal 721 (corresponding to the plurality of objects of the input signal 711).

The JOC tool, and notably the A-JOC tool, may be used to determine JOC parameters which allow upmixing a given downmix signal to an upmixed signal such that the upmixed signal approximates a given target signal. By way of example, the JOC parameters may be determined such that a certain error (e.g. a mean-square error) between the upmix signal and the target signal is reduced, notably minimized.

The "joint object coding" (implemented e.g. in modules 120 and/or 330 for encoding, and in module 220 for decoding) may be described as parameter-controlled time/frequency dependent upmixing from a multi-channel downmix signal to a signal with a higher number of channels and/or objects (optionally including the use of decorrelation in the upmix process). Specific examples are JOC as used in combination with DD+ (e.g. JOC according to ETSI TS 103 420) and A-JOC as included in AC-4 (e.g. according to ETSI TS 103 190).

"Joint object coding" may also be performed in the context of the coding of VR (virtual reality) content, which may be composed of a relatively large number of audio elements, including dynamic audio objects, fixed audio channels and/or scene-based audio elements such as Higher Order Ambisonics (HOA). A content ingestion engine (comparable to modules 110 or 320) may be used to generate objects 303 and/or a residual signal 302 from the VR content. Furthermore, a downmix module 310 may be used to generate a downmix signal 304 (e.g. in a B-format). The downmix signal 304 may e.g. be encoded using an 3GPP EVS encoder. In addition, metadata may be computed, which enables an upmixing of the (energy compacted) downmix signal 304 to the dynamic audio objects and/or to the higher Order Ambisonics scene. This metadata may be viewed as being the joint (object) coding parameters 305, which are described in the present document.

Figure 1:
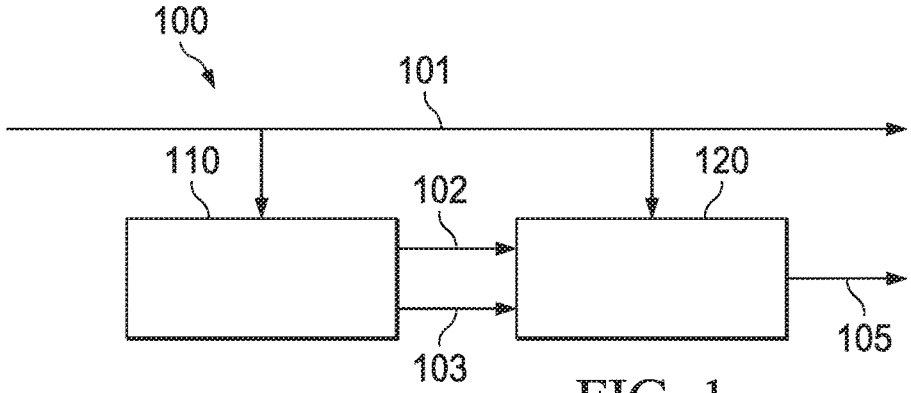

FIG. 1 shows a block diagram of an example encoding unit or encoding device 100 for encoding a soundfield representation (SR) input signal 101, e.g. an $L^{th}$ order ambisonics signal. The encoding unit 100 may be part of the encoding unit 710 of an object-based coding system 700, such as an AC-4 coding system 700. The encoding unit 100 comprises an object extraction module 110 which is configured to extract one or more objects 103 from the SR input signal 101. For this purpose, the SR input signal 101 may be transformed into the subband domain, e.g. using a QMF transform or a FFT-based transform or another time/frequency transform enabling frequency selective processing, thereby providing a plurality of SR subband signals. The transform, notably the QMF transform or the FFT-based transform, may exhibit a plurality of uniformly distributed subbands, wherein the uniformly distributed subbands may be grouped using a perceptual scale such as the Bark scale, in order to reduce the number of subbands. Hence, a plurality of SR subband signals may be provided, wherein the subbands may exhibit a non-uniform (perceptually motivated) spacing or distribution. By way of example, the transform, notably the QMF transform or the FFT-based transform, may exhibit 64 subbands which may be grouped e.g. into m=19 (non-uniform) subbands.

As indicated above, the SR input signal 101 typically comprises a plurality of channels (notably $(L+1)^2$ channels). By consequence, the SR subband signals each comprise a plurality of channels (notably $(L+1)^2$ channels for an $L^{th}$-order HOA signal).

For each SR subband signal a dominant direction of arrival (DOA) may be determined, thereby providing a plurality of dominant DOAs for the corresponding plurality of SR subband signals. For example, the dominant direction of arrival of an SR (subband) signal may be derived, as an (x,y,z) vector, from the covariance of the W channel with the X, Y and Z channels, respectively, as known in the art. Hence, a plurality of dominant DOAs may be determined for the plurality of subbands. The plurality of dominant DOAs may be clustered to a certain number n of dominant DOAs for n objects 103. Using the n dominant DOAs, the object signals 601 for the n audio objects 103 may be extracted from the plurality of SR subband signals. Furthermore, the object metadata 602 for the n objects 103 may be derived from the n dominant DOAs. The number of subbands of the subband transform may be 10, 15, 20 or more. The number of objects 103 may be n=2, 3, 4 or more.

The n objects 103 may be subtracted and/or removed from the SR input signal 101 to provide a residual signal 102, wherein the residual signal 102 may be represented using a soundfield representation, e.g. using the BH format or the ISF format.

Figure 3:
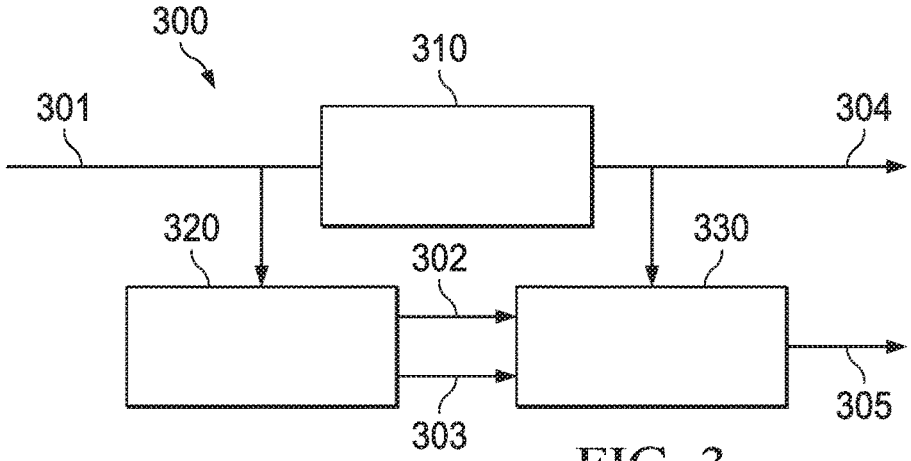
FIG. 3 shows another example encoding unit for encoding a soundfield representation signal.

The n objects 103 may be encoded within a joint object coding (JOC) module 120, in order to provide JOC parameters 105. The JOC parameters 105 may be determined such that the JOC parameters 105 may be used to upmix a downmix signal 101 which approximates the object signals 601 of the n objects 103 and the residual signal 102. The downmix signal 101 may correspond to the SR input signal 101 (as illustrated in FIG. 1) or may be determined based on the SR input signal 101 by a downmixing operation (as illustrated in FIG. 3).

The downmix signal 101 and the JOC parameters 105 may be used within a corresponding decoder 200 to reconstruct the n objects 103 and/or the residual signal 102. The JOC parameters 105 may be determined in a precise and efficient manner within the subband domain, notably the QMF domain or in a FFT-based transform domain. In a preferred example, object extraction and joint object coding are performed within the same subband domain, thereby reducing the complexity of the encoding scheme.

For determining the JOC parameters 105, the object signals 601 of the one or more objects 103 and the residual signal 102 may be transformed into the subband domain and/or may be processed within the subband domain. Furthermore, the downmix signal 101 may be transformed into the subband domain Subsequently, JOC parameters 105 may be determined on a per subband basis, notably such that by upmixing a subband signal of the downmix signal 101 using the JOC parameters, an approximation of subband signals of the object signals 601 of the n objects 103 and of the residual signal 102 is obtained. The JOC parameters 105 for the different subbands may be inserted into a bitstream 701 for transmission to a corresponding decoder.

Hence, an SR input signal 101 may be represented by a downmix signal 101 and by JOC parameters 105, as well as by object metadata 602 (for the n objects 103 that are described by the downmix signal 101 and the JOC parameters 105). The JOC downmix signal 101 may be waveform encoded (e.g. using the ASF of AC-4). Furthermore, data regarding the waveform encoded signal 101 and the metadata 105, 602 may be included into the bitstream 701.

The conversion of the SR input signal 101 into n objects 103 and a residual signal 102, which are encoded using JOC, is beneficial over direct joint object coding of the initial SR input signal 101, because object extraction leads to a compaction of energy to a relatively low number n of objects 103 (compared to the number of channels of the SR input signal 101), thereby increasing the perceptual quality of joint object coding.

Figure 2:
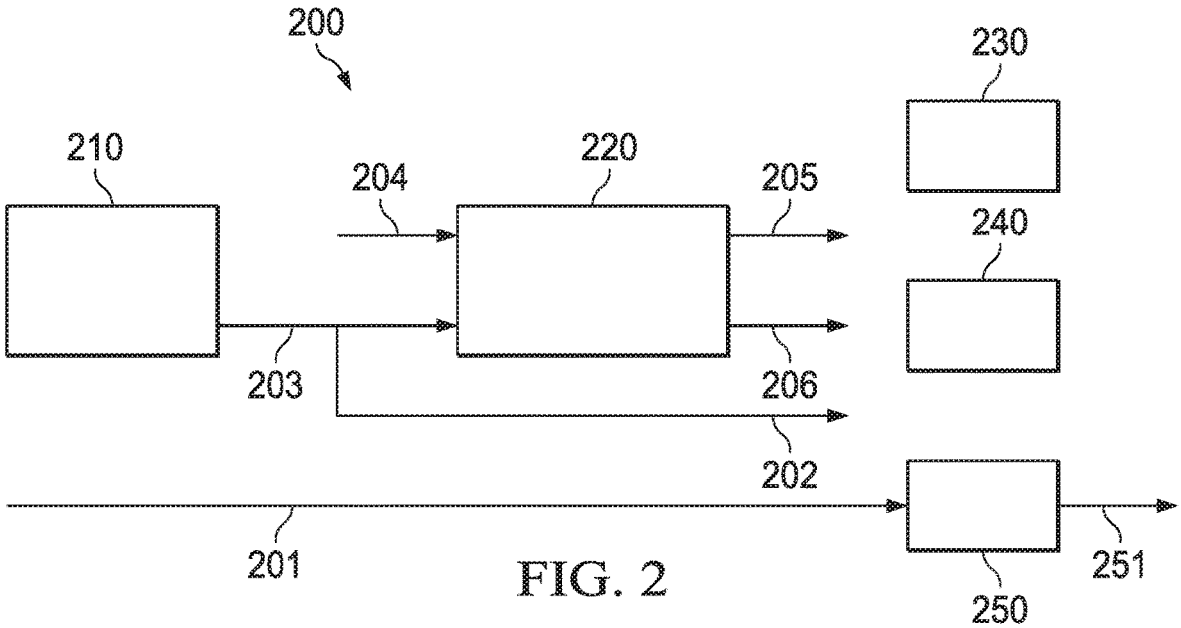
FIG. 2 shows an example decoding unit for decoding a soundfield representation signal.

FIG. 2 shows an example decoding unit or decoding device 200 which may be part of the decoding unit 720 of an object-based coding system 700. The decoding unit 200 comprises a core decoding module 210 configured to decode the waveform encoded signal 101 to provide a decoded downmix signal 203. The decoded downmix signal 203 may be processed in a JOC decoding module 220 in conjunction with the JOC parameters 204, 105 and the object metadata 602 to provide n reconstructed audio objects 206 and/or the reconstructed residual signal 205. The reconstructed residual signal 205 and the reconstructed audio objects 206 may be used for speaker rendering 230 and/or for headphone rendering 240. Alternatively, or in addition, the decoded downmix signal 203 may be used directly for an efficient and/or low complexity rendering (e.g. when performing low spatial resolution rendering).

The encoding unit 100 may be configured to insert SR metadata 201 into the bitstream 701, wherein the SR metadata 201 may indicate the soundfield representation format of the SR input signal 101. By way of example, the order L of the ambisonics input signal 101 may be indicated. The decoding unit 200 may comprise a SR output stage 250 configured to reconstruct the SR input signal 101 based on the one or more reconstructed objects 206 and based on the reconstructed residual signal 205 to provide a reconstructed SR signal 251.

In particular, the reconstructed residual signal 205 and the object signals 601 of the one or more reconstructed objects 206 may be transformed into and/or may be processed within the subband domain (notably the QMF domain or in a FFT-based transform domain), and the subband signals of the object signals 601 may be assigned to different channels of a reconstructed SR signal 251, in dependency of the respective object metadata 602. Furthermore, the different channels of the reconstructed residual signal 205 may be assigned to the different channels of the reconstructed SR signal 251. This assignment may be performed within the subband domain. Alternatively, or in addition, the assignment may be performed within the time domain. For the assignment, panning functions may be used. Hence, an SR input signal 101 may be transmitted and reconstructed in a bit-rate efficient manner.

FIG. 3 shows another encoding unit 300 which comprises a SR downmix module 310 that is configured to downmix an SR input signal 301 to an SR downmix signal 304, wherein the SR downmix signal 304 may correspond to the downmix signal 101 (mentioned above). The SR downmix signal 304 may e.g. be generated by selecting one or more channels from the SR input signal 301. By way of example, the SR downmix signal 304 may be an $(L-1)^{th}$ order ambisonics signal generated by selecting the $L^2$ lower resolution channels from the $(L+1)^2$ channels of the L order ambisonics input signal 301.

Furthermore, the encoding unit 300 may comprise an object extraction module 320 which works in an analogous manner to the extraction module 120 of encoding unit 100, and which is configured to derive n objects 303 from the SR input signal 301. The n extracted objects 303 and/or the residual signal 302 may be encoded using a JOC encoding module 330 (working in an analogous manner to the JOC encoding module 120), thereby providing JOC parameters 305. The (frequency and/or time variant) JOC parameters 305 may be determined such that the SR downmix signal 304 may be upmixed using the JOC parameters 305 to an upmix signal which approximates the object signals 601 of the n objects 303 and the residual signal 302. In other words, the JOC parameters 305 may enable upmixing of the SR downmix signal 304 to the multi-channel signal given by the object signals 601 of the n objects 303 and by the residual signal 302.

The residual signal 302 may be determined based on the SR input signal 301 and based on the n objects 303. Furthermore, the SR downmix signal 304 may be taken into account and/or encoded. Data regarding the SR downmix signal 304, the JOC parameters 305, and/or the object metadata 602 for the n objects 303 may be inserted into a bitstream 701 for transmission to the corresponding decoding unit 200.

The corresponding decoding unit 200 may be configured to perform an upmixing operation (notably within the SR output module 250) to reconstruct the SR input signal 301.

Hence, the present document describes AC-4 encoders/decoders supporting native delivery of SR signals 101, 301 in B-Format and/or Higher Order Ambisonics (HOA). An AC-4 encoder 710 and/or decoders 720 may be modified to include support for soundfield representations such as ambisonics, including B-Format and/or HOA. In an example, B-format and/or HOA content may be ingested into an AC-4 encoder 710 that performs optimized encoding to generate a bitstream 701 that is compatible with existing AC-4 decoders 720. Additional signaling (notably SR metadata 201) may be introduced into the bitstream 701 to indicate encoder soundfield related information allowing for the detection of information related to the determination of a B-Format/HOA output stage 250 of an AC-4 decoder 720. Native support for B-Format/HOA in AC-4 may be added to a coding system 700 based on:

i. using signaling capabilities to indicate an HOA input;
ii. leveraging existing coding tools, and/or
iii. adding an HOA output stage 250 on the decoder side to allow for the capability to transform back the received bitstream 701 to the signaled original HOA order.

For encoding/decoding HOA content in AC-4 with existing coding tools, signaling mechanisms and/or encoder modules 100, 300 that pre-process the content may be added. Furthermore, additional rendering 250 may be added on the decoder side. In particular, A-JOC (Advanced Joint Object Coding) and/or waveform coding tools of AC-4 may be re-used.

In the following, encode and decode scenarios for an input signal 101, 301 ranging from a B-format to a L-order (e.g., $3^{rd}$ order) HOA signal are discussed. These scenarios may consider object extraction of one or more audio objects 103, 303 from an HOA signal 101, 301 based on A-JOC T/F (time/frequency) tiling;

different playback configurations for different orders of HOA input signals 101, 301 as a function of a representation of one or more spatial residuals, a number n of extracted objects 103, 303, and/or a representation of an A-JOC downmix signal 101, 304;

native support for an HOA improved B-format representation for a B-format input signal 101, 301, with the ability to differentiate rendering;

backwards compatibility with existing decoders; and/or core/full decode of HOA signals 101, 301.

In the following AC-4 delivery of ambisonics signals 101, 301 is described. As illustrated in FIG. 1, as part of the encoding process of a soundfield representation signal 101, such as a B-Format ambisonics signal, the soundfield representation signal 101 may be separated into bed-channel-objects 102 (i.e. a residual signal) and/or dynamic objects 103 using an object extraction module 110. Furthermore, the objects 102, 103 may be parameterized using A-JOC coding in a joint object coding (JOC) module 120. In particular, FIG. 1 illustrates an exemplary mapping of object extraction to the A-JOC encoding process.

FIG. 1 illustrates an exemplary encoding unit 100. The encoding unit 100 receives an audio input 101 which may be in a soundfield format (e.g., B-Format ambisonics, ISF format such as ISF 3.1.0.0 or BH3.1.0.0). The audio input 101 may be provided to an object extraction module 110 that outputs a (multi-channel) residual signal 102 and one or more objects 103. The residual signal 102 may be in one of a variety of formats such as B-Format, BH3.1.0.0, etc. The one or more objects 103 may be any number of 1, 2, . . . , n objects. The residual signal 102 and/or the one or more objects 103 may be provided to an A-JOC encoding module 120 that determines A-JOC parameters 105. The A-JOC parameters 105 may be determined to allow upmixing of the downmix signal 101 to approximate the object signals 601 of the n objects 103 and the residual signal 102.

In an example, the object extraction module 110 is configured to extract one or more objects 103 from the input signal 101, which may be in a soundfield representation (e.g., B-Format Ambisonics, ISF format). In a particular example, a B-format input signal 101 (comprising four channels) may be mapped to eight static objects (i.e. to a residual signal 102 comprising 8 channels) in a 4.0.2.2 configuration (i.e. a 4.0 channel horizontal layer, a 2 channel upper layer and a 2 channel lower layer), and may be mapped to two dynamic objects 103, for a total of ten channels. No specific LFE treatment may be done. The eight static objects may correspond to eight Atmos objects of the Dolby Atmos technology at static locations: four on the horizontal plane (at four corners of the Atmos square) and a total of four on the midpoints of the side-edges of the upper and lower (z=1 and z=−1) planes of the Atmos cube. If these static objects were assigned to bed channels, the 4 objects of the horizontal plane could be L, R, LS, RS, the ceiling channels could be TL, TR, and the floor channels could be BL, BR.

In an example, the object extraction module 110 may perform an algorithm that analyzes the input signal 101 in m=19 different (non-uniformly distributed) subbands (e.g. using a time-frequency transform such as a quadrature mirror filter (QMF) or a FFT-based transform, in combination with perceptual grouping or banding of subbands), and that determines a dominant direction of arrival in each subband. The algorithm then clusters the dominant directions of arrival within the different subbands to determine n overall dominant directions (e.g., n=2), wherein the n overall dominant directions may be used as the object locations for the n objects 103. In each subband, a component and/or a fraction of the input signal 101 may be diverted to each of the objects 103, and the residual B-format component may then be used as a static object and/or bed and/or ISF stream to determine the residual signal 102.

In case of a higher-resolution input signal 101 (e.g., $L^{th}$ order HOA such as $3^{rd}$ order HOA) an increased number n of objects 103 may be extracted (e.g. n=3, 4, or more).

As indicated above, the object extraction may be performed in m subbands (e.g., m=19 subbands). If the same T/F tiling (i.e. the same time-frequency transform and/or the same subband grouping) is used for object extraction as for the subsequent JOC coding, the JOC encoder 120 may make use of the upmix matrix of the object extraction module 110, so that the JOC encoder 120 can apply this matrix on the covariance matrix of the downmix signal 101, 304 (e.g. a B-format signal expressed as BH3.1.0.0).

A corresponding decoder can decode and directly render the downmix signal 101, 304 (with minimum decode complexity). The decode and rendition of the downmix signal 101, 304 may be referred to as "core decode" in that it only decodes a core representation of the signal, at relatively low computational complexity. The downmix signal 101, 304 may be a SR signal in B-format represented as BH3.1.0.0. Alternatively, or in addition, the decoder may apply the JOC decoder to re-generate the object extracted version of the SR input signal 101 for higher spatial precision in rendering.

A residual signal 102 using a B-format lends itself to being fed through a BH3.1.0.0 ISF path (e.g. of a Dolby Atmos system). The BH3.1.0.0 format comprises four channels that correspond approximately to the (C, LS, RS, Zenith) channels, with the property that the channels may be losslessly converted to/from B-format with a 4×4 linear mixing operation. The BH3.1.0.0 format may also be referred to as SR3.1.0.0. On the other hand, if the ISF option is not available, the algorithm may use 8 static objects (e.g., in 4.0.2.2 format). If the algorithm is changed to work with $L^{th}$ (e.g., $3^{rd}$) order HOA input, then the residual signal 302 may be represented in a format like 4.1.2.2 (or BH7.5.3.0 or BH5.3.0.0), but the downmix signal 304 may be simplified e.g. to BH3.1.0.0 to facilitate AC4 coding.

In an example, an AC4 and/or Atmos format may be used to carry any arbitrary soundfield, regardless of whether the soundfield is described as B-Format, HOA, Atmos, 5.1, mono. The soundfield may be rendered on any kind of speaker (or headphone) system.

FIG. 2 illustrates an exemplary decoding unit 200. A core decoder 210 may receive an encoded audio bitstream 701 and may decode a reconstructed (multi-channel) downmix signal 203. In an example, the core decoder 210 may decode the reconstructed downmix signal 203 and may determine the type of format of the reconstructed downmix signal 203 based on the data from the encoded bitstream 701. For example, the core decoder 210 may determine that the downmix signal 203 exhibits a B-Format or a BH3.1.0.0 format. The core decoder 210 may further provide a core decoder mode output 202 for use in rendering the downmix signal 203 (e.g., via speaker rendering 230 or headphone rendering 240).

An A-JOC decoder 220 may receive A-JOC parameters 204 and the decoded downmix signal (e.g., B-Format signal) 203. The A-JOC decoder 220 decodes this information to determine a spatial residual 205 and n objects 206, based on the downmix signal 203 and based on the JOC parameters 204. The spatial residual 205 may be of any format, such as B-Format ambisonics or BH3.1.0.0 format. In an example, the spatial residual 205 is a B-Format ambisonics and the number n of objects 206 is n=2. In an example, a first headphone renderer (e.g., headphone renderer 240) may operate on the core decoder output B-Format signal 202 and a second headphone renderer may operate on the object extracted signal 206 and the corresponding B-format residual 205. In an example, for rendering over headphones and/or when using a relatively high number n (e.g. n=3, 4, 5 or more) of objects 206 extracted, the B-Format (BH3.1.0.0) residual signal 205 may not be needed.

In a preferred embodiment, the dimension (e.g., the number of channels) of the residual signal 205 is the same as or higher than the dimension of the downmix signal 203.

FIG. 3 illustrates an encoding unit 300 for encoding an audio input stream 301 in an HOA format (e.g., preferably $L^{th}$ order such as $3^{rd}$ order HOA). A downmix renderer 310 may receive the $L^{th}$ (e.g., $3^{rd}$) order HOA audio stream 301 and may downmix the audio stream 301 to a spatial format, such as B-Format ambisonics, BH3.1.0.0, 4.x.2.2 beds, etc. In an example, the downmix renderer 310 downmixes the HOA signal 301 into a B-Format downmix signal 304.

An object extraction module 320 may receive the HOA signal, e.g., the $L^{th}$ (e.g., $3^{rd}$) order HOA signal 301. The object extraction module 320 may determine a spatial residual 302 and n objects 303. In an example, the spatial residual 302 is a $2^{nd}$ order HOA format and the number n of objects 303 is n=2. An A-JOC encoder 330 may perform A-JOC encoding based on the spatial residual 302 (e.g., $2^{nd}$ order HOA residual), based on the n objects 303 (n=2), and/or based on the B-format downmix signal 304 to determine A-JOC parameters 305.

As indicated above, FIG. 2 shows an example decoding unit 200. The decoding unit 200 may receive information 201 (i.e. SR metadata) regarding:

- the type of format of the original audio signal 301 (e.g., preferably $3^{rd}$ order HOA);
- the type of format of the downmixed signal 304;
- HOA metadata (e.g., the order of the original HOA signal), if the original signal 301 is an HOA signal; and/or
- the format of the spatial residual 302.

A core decoder 210 may receive an encoded audio bitstream 701. The core decoder 210 may determine a downmix signal 203 which may be in any format, such as B-format ambisonics, HOA, 4.x.2.2 beds, ISF, BH3.1.0.0, etc. The core decoder 310 may further output a core decode mode output 202 that may be used in rendering decoded audio for play back (e.g., speaker rendering 230, headphone rendering 240) directly using the downmix signal 203.

An A-JOC decoder 220 may utilize A-JOC parameters 204 and the downmix signal 203 (e.g., preferably in B-format ambisonics format) to determine a spatial residual 205 and n objects 206. The spatial residual 205 may be in any format, such as an HOA format, B-format Ambisonics, ISF format, 4.x.2.2 beds, and BH3.1.0.0. Preferably, the spatial residual 205 may be of a $2^{nd}$ order Ambisonics format if the original audio signal is a $L^{th}$ (e.g., $3^{rd}$) order HOA signal, with L>2. The n objects 406 may be any of 2, . . . , n, preferably with n=2. The decoder 200 may include an HOA output unit 250 which, upon receiving an indication of an order and/or format of the HOA output 251, may process the spatial residual 205 and the n objects 206 into an HOA output 251 and may provide the HOA output 251 for audio playback. The HOA output 251 may then be rendered e.g., via speaker rendering 230 or headphone rendering 240.

In all of the above, from a decoder's perspective, signaling may be added to the bitstream 701 to signal that the original input 301 was HOA (e.g., using SR metadata 201), and/or an HOA output stage 250 may be added that converts the decoded signals 205, 206 into an HOA signal 251 of the order signaled. The HOA output stage 250 may be configured to, similarly to a speaker rendering output stage, take as input on the decoder side a requested HOA order (e.g. based on the SR metadata 201).

In an example, a decoded signal representation may be transformed to an HOA output representation, e.g. if requested through the decoder API (application programming interface). For example, a VR (virtual reality) playback system may request all the audio being supplied from an AC-4 decoder 700, 200 to be provided in an $L^{th}$ (e.g., $3^{rd}$) order HOA format, regardless the format of the original audio signal 301.

AC-4 codec(s) may provide ISF support and may include the A-JOC tool. This may require the provision of a relatively high order ISF format as input signal 301, and this may require creation of a downmix signal 304 (e.g. a suitable lower order ISF) that may be coded along with the JOC parameters 305 needed for the A-JOC decoder to recreate the higher order ISF on the decoder side. This may require the step of translating an $L^{th}$ (e.g., $3^{rd}$) order HOA input signal 301 into a suitable ISF (e.g. BH7.5.3.0) format, and the step of adding a signaling mechanism and an HOA output stage 250. The HOA output stage 250 may be configured to translate an ISF representation to HOA.

In an example, by making use of an object extraction technique on the encoder side, HOA signals may be represented more efficiently (i.e. using a fewer number of signals) compared to an ISF representation. An internal representation and coding scheme may allow for a more accurate translation back to HOA. Object extraction techniques on the encoder side may be used to compactly code and represent an improved B-format signal for a given B-format input.

In an example, the original input HOA order may be signaled to the HOA output stage 250. In another example, backwards compatibility may be provided, i.e., the AC-4 decoder may be configured to provide an audio output regardless of the type of the input signal 301.

As outlined above in the context of FIG. 1, the SR input signal 101 may be encoded and provided within the bitstream 700, in addition to joint object coding parameters 105. By doing this, a corresponding decoder is enabled to efficiently derive (reconstructed) audio objects 206 and/or a (reconstructed) residual signal 206. Such audio objects 206 may enable an enhanced rendering compared to the direct rendering of the SR input signal 101. Hence, the encoder 100 according to FIG. 1 allows to generate a bitstream 700 that, when decoded, may result in an improved quality playback compared to direct rendering of the SR input signal 101 (e.g. a first or higher order ambisonics signal). In other words, the object extraction 110, which may be performed by the encoder 100, enables an improved quality playback (notably with an improved spatial localization). By doing this, the object-extraction process (performed by module 110) may be performed by the encoder 100 (and not by the decoder 200), thereby reducing the computational complexity for a rendering device and/or a decoder.

The encoder 300 of FIG. 3 typically provides an improved coding efficiency (compared to the encoder 100 of FIG. 1), notably by (waveform) encoding the downmix signal 304 instead of the SR input signal 101. In other words, the encoding system 300 of FIG. 3 allows for an improved coding efficiency (compared to the encoding system 100 of FIG. 1), by using the downmix module 310 to reduce the number of channels in the downmix signal 304 compared to the SR input signal 301, hence enabling the coding system to operate at reduced bitrates.

Figure 4:
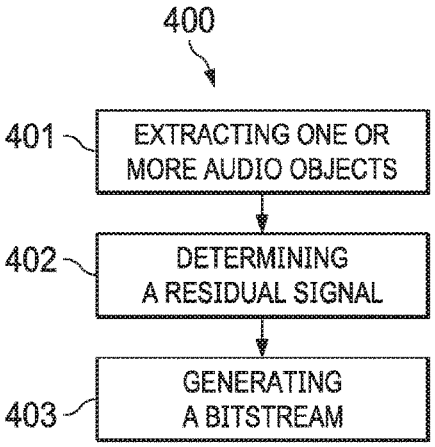
FIG. 4 shows a flow chart of an example method for encoding a soundfield representation signal.

FIG. 4 shows a flow chart of an example method 400 for encoding a soundfield representation (SR) input signal 101, 301 which describes a soundfield at a reference position. The reference position may be the listening position of a listener and/or the capturing position of a microphone. The SR input signal 101, 301 comprises a plurality of channels (or waveforms) for a plurality of different directions of arrival of the soundfield at the reference position.

An SR signal, notably the SR input signal 101, 301, may comprise an L-order ambisonics signal, with L greater than or equal to 1. Alternatively, or in addition, an SR signal, notably the SR input signal 101, 301, may exhibit a beehive (BH) format with the plurality of directions of arrival being arranged in a plurality of different rings on a sphere around the reference position. The plurality of rings may comprise a middle ring, an upper ring, a lower ring and/or a zenith. Alternatively, or in addition, an SR signal, notably the SR input signal 101, 301, may exhibit an intermediate spatial format, referred to as ISF, notably the ISF format as defined within the Dolby Atmos technology. As outlined in the present document, the ISF format may be viewed as a special case of the BH format.

Hence, the plurality of different directivity patterns of the plurality of channels of the SR input signal 101, 301 may be arranged in a plurality of different rings of a sphere around the reference position, wherein the different rings exhibit different elevation angles. As indicated above, the different rings may comprise a middle ring, an upper ring, a lower ring and/or a zenith. Different directions of arrival on the same ring typically exhibit different azimuth angles, wherein the different directions of arrival on the same ring may be uniformly distributed on the ring. This is the case e.g. for an SR signal according to the BH format and/or the ISF format.

Each channel of the SR input signal 101, 301 typically comprises a sequence of audio samples for a sequence of time instants or for a sequence of frames. In other words, the "signals" described in the present document typically comprise a sequence of audio samples for a corresponding sequence of time instants or frames (e.g. at a temporal distance of 20 ms or less).

The method 400 comprises extracting 401 one or more audio objects 103, 303 from the SR input signal 101, 301. An audio object 103, 303 typically comprises an object signal 601 (with a sequence of audio samples for the corresponding sequence of time instants or frames). Furthermore, an audio object 103, 303 typically comprises object metadata 602 indicating a position of the audio object 103, 303. The position of the audio object 103, 303 may change over time, such that the object metadata 602 of an audio object 103, 303 may indicate a sequence of positions for the sequence of time instants or frames.

Furthermore, the method 400 comprises determining 402 a residual signal 102, 302 based on the SR input signal 101, 301 and based on the one or more audio objects 103, 303. The residual signal 102, 302 may describe the original soundfield from which the one or more audio objects 103, 303 have been extracted and/or removed. The residual signal 102, 302 may be an SR signal (e.g. an $L^{th}$ order ambisonics signal and/or an SR signal using the BH and/or the ISF format, notably with L=1). Alternatively, or in addition, the residual signal 102, 302 may comprise or may be a multichannel audio signal and/or a bed of audio signals. Alternatively, or in addition, the residual signal 102, 302 may comprise a plurality of audio objects at fixed object locations and/or positions (e.g. audio objects which are assigned to particular speakers of a defined arrangement of speakers).

The method 400 may comprise transforming the SR input signal 101, 301 into a subband domain, notably a QMF domain or a FFT-based transform domain, to provide a plurality of SR subband signals for a plurality of different subbands. In particular, m different subbands may be considered, e.g. with m equal to 10, 15, 20 or more. Hence, a subband analysis of the SR input signal 101, 301 may be performed. The subbands may exhibit a non-uniform width and/or spacing. In particular, the subbands may correspond to grouped subbands derived from a uniform time-frequency transform. The grouping may have been performed using a perceptual scale, such as the Bark scale.

Furthermore, the method 400 may comprise determining a plurality of dominant directions of arrival for the corresponding plurality of SR subband signals. In particular, a dominant DOA may be determined for each subband. The dominant DOA for a subband may be determined as the DOA having the highest energy (compared to all other possible directions). The method 400 may further comprise clustering the plurality of dominant directions of arrival to n clustered directions of arrival, with n>0 (notably n=2 or more). Clustering may be performed using a known clustering algorithm.

n audio objects 103, 303 may then be extracted based on the n clustered directions of arrival. Hence, a subband analysis of the SR input signal 101, 301 may be performed to determine n clustered (dominant) directions of arrival of the SR input signal 101, 301, wherein the n clustered DOAs are indicative of n dominant audio objects 103, 303 within the original soundfield represented by the SR input signal 101, 301.

The method 400 may further comprise mapping the SR input signal 101, 301 onto the n clustered directions of arrival to determine the object signals 601 for the n audio objects 103, 303. By way of example, the different channels of the SR input signal 101, 301 may be projected onto the n clustered directions of arrival. For each of the n objects, the object signal 601 may be derived by mixing the channels of the SR input signal so as to extract a signal indicative of the soundfield in the corresponding direction of arrival. Furthermore, the object metadata 602 for the n audio objects 103, 303 may be determined using the n clustered directions of arrival, respectively.

In addition, the method 400 may comprise, for each of the plurality of subbands, subtracting subband signals for the object signals 601 of the n audio objects 103, 303 from the SR subband signals, to provide a plurality of residual subband signals for the plurality of subbands. The residual signal 102, 302 may then be determined based on the plurality of residual subband signals. Hence, the residual signal 102, 302 may be determined in a precise manner within the subband, notably the QMF or FFT-based transform, domain.

Furthermore, the method 400 comprises generating 403 a bitstream 701 based on the one or more audio objects 103, 303 and based on the residual signal 102, 302. The bitstream 701 may use the syntax of an object-based coding system 700. In particular, the bitstream 701 may use an AC-4 syntax.

Hence, a method 400 is described which enables a bit-rate efficient transmission and high quality encoding of an SR input signal 101, 301, notably using an object-based coding scheme.

The method 400 may comprise waveform coding of the residual signal 102, 302 to provide residual data. The bitstream 701 may be generated in a bit-rate efficient manner based on the residual data.

The method 400 may comprise joint coding of the one or more audio objects 103, 303 and/or of the residual signal 102, 302. In particular, the object signals 601 of the one or more audio objects 103, 303 may be coded jointly with the one or more channels of the residual signal 102, 302. For this purpose, joint object coding (JOC), notably A-JOC, may be used. The joint coding of the object signals 601 of the one or more audio objects 103, 303 and of the one or more channels of the residual signal 102, 302 may involve exploiting a correlation between the different signals and/or may involve downmixing of the different signals to a downmix signal. Furthermore, joint coding may involve providing joint coding parameters, wherein the joint coding parameters may enable upmixing of the downmix signal to approximations of the object signals 601 of the one or more audio objects 103, 303 and of the one or more channels of the residual signal 102, 302. The bitstream 701 may comprise data generated in the context of joint coding, notably data generated in the context of JOC. In particular, the bitstream 701 may comprise the joint coding parameters and/or data regarding the downmix signal. By performing joint coding of the one or more audio objects 103, 303 and/or of the residual signal 102, 302, the perceptual quality and bit-rate efficiency of the coding scheme may be improved.

Joint Coding of the one or more audio objects 103, 303 and/or of the residual signal 102, 302 may be viewed as a parameter-controlled time and/or frequency dependent upmixing from a downmix signal to a signal with an increased number of channels and/or objects. The downmix signal may be the SR downmix signal 304 (as outlined e.g. in the context of FIG. 3) and/or the SR input signal 101 (as outlined e.g. in the context of FIG. 1). The upmixing process may be controlled by joint coding parameters, notably by JOC parameters.

In the context of method 400 a plurality of audio objects 103, 303 (notably n=2, 3 or more audio objects 103, 303) may be extracted. The method 400 may comprise performing joint object coding (JOC), notably A-JOC, on the plurality of audio objects 103, 303. The bitstream 701 may then be generated in a particularly bit-rate efficient manner based on data generated in the context of joint object coding of the plurality of audio objects 103, 303.

In particular, the method 400 may comprise generating and/or providing a downmix signal 101, 304 based on the SR input signal 101, 301. The number of channels of the downmix signal 101, 304 is typically smaller than the number of channels of the SR input signal 101, 301. Furthermore, the method 400 may comprise determining joint coding parameters 105, 305, notably JOC parameters, which enable upmixing of the downmix signal 101, 301 to object signals 601 of one or more reconstructed audio objects 206 for the corresponding one or more audio objects 103, 303. Furthermore, the joint coding parameters 105, 305, notably the JOC parameters, may enable upmixing of the downmix signal 101, 301 to a reconstructed residual signal 205 for the corresponding residual signal 102, 302.

The joint coding parameters, notably the JOC parameters, may comprise upmix data, notably an upmix matrix, which enables upmixing of the downmix signal 101, 304 to object signals 601 for the one or more reconstructed audio objects 206 and/or to the reconstructed residual signal 205. Alternatively, or in addition, the joint coding parameters, notably the JOC parameters, may comprise decorrelation data which enables the reconstruction of the covariance of the object signals 601 of the one or more audio objects 103, 303 and/or of the residual signal 102, 302.

For joint coding, notably for joint object coding, the object signals 601 of the one or more audio objects 103, 303 may be transformed into the subband domain, notably into the QMF domain or a FFT-based transform domain, to provide a plurality of subband signals for each object signal 601. Furthermore, the residual signal 102, 302 may be transformed into the subband domain. The joint coding parameters 105, 305, notably the JOC parameters, may then be determined in a precise manner based on the subband signals of the one or more object signals 601 and/or the residual signal 102, 302. Hence, frequency variant joint coding parameters 105, 305, notably JOC parameters, may be determined in order to allow for a precise reconstruction of the object signals 601 of the one or more objects 103, 303 and/or of the residual signal 102, 302, based on the downmix signal 101, 304.

The bitstream 701 may be generated based on the downmix signal 101, 304 and/or based on the joint coding parameters 105, 305, notably the JOC parameters. In particular, the method 400 may comprise waveform coding of the downmix signal 101, 304 to provide downmix data and the bitstream 701 may be generated based on the downmix data.

The method 400 may comprise downmixing the SR input signal 301 to a SR downmix signal 304 (which may be the above mentioned downmix signal 101, 304). Downmixing may be used in particular, when dealing with an HOA input signal 301 i.e. an $L^{th}$ order ambisonics signal, with L>1. Downmixing the SR input signal 301 may comprise selecting a subset of the plurality of channels of the SR input signal 301 for the SR downmix signal 304. In particular, a subset of channels may be selected such that the SR downmix signal 304 is an ambisonics signal of a lower order than the order L of the SR input signal 301. The bitstream 701 may be generated based on the SR downmix signal 304. In particular, SR downmix data describing the SR downmix signal 304 may be included into the bitstream 701. By performing downmixing of the SR input signal 301, the bit-rate efficiency of the coding scheme may be improved.

The residual signal 102, 302 may be determined based on the one or more audio objects 103, 303. In particular, the residual signal 102, 302 may be determined by subtracting and/or by removing the one or more audio objects 103, 303 from the SR input signal 101, 301. As a result of this, a residual signal 102, 302 may be provided, which allows for an improved reconstruction of the SR input signal 101, 301 at a corresponding decoder 200.

The joint coding parameters 105, 305, notably the JOC parameters, may be determined in order to enable upmixing of the SR downmix signal 304 to the object signals 601 of the one or more audio objects 103, 303 and to the residual signal 102, 302. In other words, the object signals 601 of the one or more audio objects 103, 303 and the residual signal 102, 302 may be viewed (in combination) as a multi-channel upmix signal which may be obtained from the SR downmix signal 304 (alone) using an upmixing operation which is defined by the joint coding parameters 105, 305, notably the JOC parameters. The joint coding parameters 105, 305, notably the JOC parameters, are typically time-variant and/or frequency-variant. A decoder 200 may be enabled to reconstruct the object signals 601 of the one or more objects 103, 303 and the residual signal 102, 302 using (only) the data from the bitstream 701, which relates to the SR downmix signal 304 and to the joint coding parameters 105, 305, notably the JOC parameters.

The bitstream 701 may comprise data regarding the SR downmix signals 304, the joint coding or JOC parameters 105, 305 and the object metadata 602 of the one or more objects 103, 303. This data may be sufficient for a decoder 200 to reconstruct the one or more audio objects 103, 303 and the residual signal 102, 302.

The method 400 may comprise inserting SR metadata 201 indicative of the format (e.g. the BH format and/or the ISF format) and/or of the number of channels of the SR input signal 101, 301 into the bitstream 701. By doings this, an improved reconstruction of the SR input signal 101, 301 at a corresponding decoder 200 is enabled.

Figure 5:
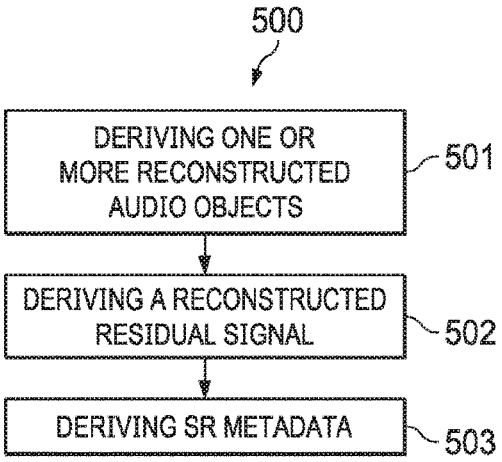
FIG. 5 shows a flow chart of an example method for decoding a bitstream indicative of a soundfield representation signal.

FIG. 5 shows a flow chart of an example method 500 for decoding a bitstream 701 indicative of a soundfield representation (SR) input signal 101, 301 representing a soundfield at a reference position is described. The SR input signal 101, 301 comprises a plurality of channels for a corresponding plurality of different directions of arrival of the soundfield at the reference position. The aspects and/or features which are described in the context of the encoding method 400 and/or in the context of the encoding device 100, 300 are also applicable in an analogous and/or complementary manner for the decoding method 500 and/or for the decoding device 200 (and vice versa).

The method 500 may comprise deriving 501 one or more reconstructed audio objects 206 from the bitstream 701. As indicated above, an audio object 206 typically comprises an object signal 601 and object metadata 602 which indicates the (time-varying) position of the audio object 206. Furthermore, the method 500 comprises deriving 502 a reconstructed residual signal 205 from the bitstream 701. The one or more reconstructed audio objects 206 and the reconstructed residual signal 205 may describe and/or may be indicative of the SR input signal 101, 301. In particular data may be extracted from the bitstream 701 which enables the determination of a reconstructed SR signal 251, wherein the reconstructed SR signal 251 is an approximation of the original input SR signal 101, 301.

In addition, the method comprises deriving 503 SR metadata 201 which is indicative of the format and/or the number of channels of the SR input signal 101, 301 from the bitstream 701. By extracting SR metadata 201, the reconstructed SR signal 251 may be generated in a precise manner.

The method 500 may further comprise determining the reconstructed SR signal 251 of the SR input signal 101, 301 based on the one or more reconstructed audio objects 206, based on the reconstructed residual signal 205 and based on the SR metadata 201. For this purpose, the object signals 601 of the one or more reconstructed audio objects 206 may be transformed into or may be processed within the subband domain, notably the QMF domain or the FFT-based transform domain. Furthermore, the reconstructed residual signal 205 may be transformed into or may be processed within the subband domain. The reconstructed SR signal 251 of the SR input signal 101, 301 may then be determined in a precise manner based on the subband signals of the object signals 601 and of the reconstructed residual signal 205 within the subband domain.

The bitstream 701 may comprise downmix data which is indicative of a reconstructed downmix signal 203. Furthermore, the bitstream 701 may comprise joint coding or JOC parameters 204. The method 500 may comprise upmixing the reconstructed downmix signal 203 using the joint coding or JOC parameters 204 to provide the object signals 601 of the one or more reconstructed audio objects 206 and/or to provide a reconstructed residual signal 205. Hence, the reconstructed audio objects 206 and/or the residual signal 205 may be provided in a bit-rate efficient manner using joint coding or JOC, notably A-JOC.

In the context of joint audio coding, the method 500 may comprise transforming the reconstructed downmix signal 203 into the subband domain, notably the QMF domain or the FFT-based transform domain, to provide a plurality of downmix subband signals 203. Alternatively, the reconstructed downmix signal 203 may be processed directly within the subband domain. Upmixing of the plurality of downmix subband signals 203 using the JOC parameters 204 may be performed, to provide the plurality of reconstructed audio objects 206. Hence, joint object decoding may be performed in the subband domain, thereby increasing the performance of joint object coding with regards to bit-rate and perceptual quality.

The reconstructed residual signal 205 may be an SR signal comprising less channels than the reconstructed SR signal 251 of the SR input signal 101, 301. Alternatively, or in addition, the bitstream 701 may comprise data which is indicative of an SR downmix signal 304, wherein the SR downmix signal 304 comprises a reduced number of channels compared to the reconstructed SR signal 251. The data may be used to generate a reconstructed SR downmix signal 203 which corresponds to the SR downmix signal 304.

The method 500 may comprise upmixing the reconstructed residual signal 205 and/or the reconstructed SR downmix signal to the number of channels of the reconstructed SR signal 251. Furthermore, the one or more reconstructed audio objects 206 may be mapped to the channels of the reconstructed SR signal 251 using the object metadata 602 of the one or more reconstructed audio objects 206. As a result of this, a reconstructed SR signal 251 may be generated, which approximates the original SR input signal 101, 301 in a precise manner.

The bitstream 701 may comprise waveform encoded data indicative of the reconstructed residual signal 205 and/or of the reconstructed SR downmix signal 203. The method 500 may comprise waveform decoding of the waveform encoded data to provide the reconstructed residual signal 205 and/or the reconstructed SR downmix signal 203.

Furthermore, the method 500 may comprise rendering the one or more reconstructed audio objects 206 and/or the reconstructed residual signal 205 and/or the reconstructed SR signal 251 using one or more renders 600. Alternatively, or in addition, the reconstructed SR downmix signal 203 may be rendered in a particularly efficient manner.

Furthermore, an encoding device 100, 300 is described which is configured to encode a soundfield representation (SR) input signal 101, 301 describing a soundfield at a reference position. The SR input signal 101, 301 comprises a plurality of channels for a plurality of different directivity patterns of the soundfield at the reference position.

The encoding device 100, 300 is configured to extract one or more audio objects 103, 303 from the SR input signal 101, 301. Furthermore, the encoding device 100, 300 is configured to determine a residual signal 102, 302 based on the SR input signal 101, 301 and based on the one or more audio objects 103, 303. In addition, the encoding device 100, 300 is configured to generate a bitstream 701 based on the one or more audio objects 103, 303 and based on the residual signal 102, 302.

Furthermore, a decoding device 200 is described, which is configured to decode a bitstream 701 indicative of a soundfield representation (SR) input signal 101, 301 describing a soundfield at a reference position. The SR input signal 101, 301 comprises a plurality of channels for a plurality of different directivity patterns of the soundfield at the reference position.

The decoding device 200 is configured to derive one or more reconstructed audio objects 206 from the bitstream 701, and to derive a reconstructed residual signal 205 from the bitstream 701. In addition, the decoding device 200 is configured to derive SR metadata 201 indicative of a format and/or a number of channels of the SR input signal 101, 301 from the bitstream 701.

The described herein encoders/decoders (e.g., decoding module 210 and/or the encoding of encoding units 100 and 300) may be compliant with current and future versions of standards such as the AC-4 standard, the MPEG AAC standard, the Enhanced Voice Services (EVS) standard, the HE-AAC standard, etc. to support Ambisonics content, including Higher Order Ambisonics (HOA) content.

In the following enumerated examples (EE) of the encoding method 400 and/or of the decoding method 500 are described.

EE 1. A method 400 for encoding a sound field representation of an audio signal 101, 103 is described, wherein the method 400 comprises:
- receiving the soundfield representation of the audio signal 101, 103;
- determining n objects 103, 303 based on the soundfield representation;
- determining a spatial residual 102, 302 based on the soundfield representation;
- encoding the n objects 103, 303 and the spatial residual 102, 302 using an A-JOC encoder 120, 330 to determine A-JOC parameters 105, 305;
- outputting the encoded A-JOC parameters 105, 305 in a bitstream 701.

EE 2. The method 400 of EE 1, wherein the format of the soundfield is one of ISF, B-format or HOA.

EE 3. The method 400 of EE 1, wherein the format of the soundfield representation is signaled to a decoder 200 (e.g. using SR metadata 201).

EE 4. The method 400 of EE 1, wherein when the format is of a $L^{th}$ order HOA, with L>1, the encoder 100, 300 further comprises a downmix module 310 for downmixing the $L^{th}$ order HOA to B-format ambisonics and providing the downmixed B-format ambisonics to the A-JOC encoder 330 for encoding.

EE 5. The method 400 of EE 4, wherein $L^{th}$ order=$3^{rd}$ order.

EE 6. The method 400 of EE 1, wherein n=2.

EE 7. The method 400 of EE 1, wherein the format of the spatial residual 102, 302 is one of ISF, B-format, HOA or 4.x.2.2 beds.

EE 8. The method 400 of EE 1, wherein the format of the spatial residual 102, 302 is B-format.

EE 9. The method 400 of EE 1, wherein the object extraction includes
- analyzing the audio in m subbands, and determining a dominant direction of arrival in each subband;
- clustering the subband results to determine n dominant directions, which become the object locations;
- in each subband, diverting a component of the signal 101, 301 to each object 103, 303, and the residual B-format component is then passed through as a static/object/bed/ISF stream.

EE 10. The method 400 of EE 9, wherein m=19 and n=2.

EE 11. A method 500 for decoding an encoded audio stream 701 comprising:
- receiving the encoded audio stream 701 with an indication 201 that the original audio 101, 301 has a soundfield representation;
- core decoding the encoded audio stream 701 to determine a downmix signal 203; and
- A-JOC decoding the downmix signal 203 to determine a spatial residual 205 and n objects 206;
- rendering the spatial residual 205 and n objects 206 for audio playback.

EE 12. The method 500 of EE 11, further comprising receiving an indication 201 of a format of the downmix signal 203.

EE 13. The method 500 of EE 11, wherein a format of the downmix signal 203 is one of a B-format, ISF, and 4.x.2.2 beds format.

EE 14. The method 500 of EE 11, wherein, based on an indication 201 that the encoded audio stream 701 has a $L^{th}$ order HOA format, the core decoding comprises downmixing the $L^{th}$ order HOA to a B-format ambisonics representation.

EE 15. The method 500 of EE 11, further comprising receiving an indication 201 of a format of the original audio signal 101, 301.

EE 16. The method 500 of EE 15, wherein the format is a $3^{rd}$ order HOA format.

EE 17. The method 500 of EE 15, wherein, when the indication of the format of the original audio signal 101, 301 indicates that the signal is an HOA audio signal, the decoding further includes an HOA output stage 250 for determining an HOA signal 251 based on HOA metadata 201, the spatial residual 205 and the n objects 206.

EE 18. The method 500 of EE 17, wherein the HOA metadata 201 indicates an HOA order of the original audio signal 101, 301.

EE 19. The method 500 of EE 11, further comprising receiving an indication 201 of the number n of objects.

EE 20. The method 500 of EE 11, wherein n=2.

EE 21. The method 500 of EE 11, further comprising receiving an indication 201 of the format of the spatial residual 205.

EE 22. The method 500 of EE 11, wherein a format of the spatial residual 205 is one of $2^{nd}$ order HOA, B-format ambisonics, ISF format (e.g., BH3.1.0.0.), and 4.x.2.2 beds.

EE 23. The method 500 of EE 11, wherein the rendering comprises one of headphone rendering, speaker rending.

Various example embodiments of the present invention may be implemented in hardware or special purpose circuits, software, logic or any combination thereof. Some aspects may be implemented in hardware, while other aspects may be implemented in firmware or software, which may be executed by a controller, microprocessor or other computing device. In general, the present disclosure is understood to also encompass an apparatus suitable for performing the methods described above, for example an apparatus (spatial renderer) having a memory and a processor coupled to the memory, wherein the processor is configured to execute instructions and to perform methods according to embodiments of the disclosure.

While various aspects of the example embodiments of the present invention are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller, or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, embodiments of the present invention include a computer program product comprising a computer program tangibly embodied on a machine-readable medium, in which the computer program containing program codes configured to carry out the methods as described above.

In the context of the disclosure, a machine-readable medium may be any tangible medium that may contain, or store, a program for use by or in connection with an instruction execution system, apparatus, or device. The machine-readable medium may be a machine-readable signal medium or a machine-readable storage medium. A machine-readable medium may include but is not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention, or of what may be claimed, but rather as descriptions of features that may be specific to particular embodiments of particular inventions. Certain features that are described in this specification in the context of separate embodiments may also may be implemented in combination in a single embodiment. Conversely, various features that are described in the context of a single embodiment may also may be implemented in multiple embodiments separately or in any suitable sub-combination.

It should be noted that the description and drawings merely illustrate the principles of the proposed methods and apparatus. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the proposed methods and apparatus and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

What is claimed is:

1. A method for encoding a soundfield representation (SR) of a SR, input signal describing a soundfield at a reference position, wherein the SR input signal comprises a plurality of channels for a plurality of different directivity patterns of the soundfield at the reference position, the method comprising:

extracting one or more audio objects from the SR input signal, wherein the one or more audio objects comprise at least an object signal and object metadata indicating a position of the audio object;

determining a residual signal based on the SR input signal and based on the one or more audio objects;

downmixing the SR input signal to a SR downmix signal;

performing joint object coding (JOC) of the one or more audio objects and the residual signal to determine JOC parameters for enabling upmixing of the SR downmix signal to one or more reconstructed audio objects corresponding to the one or more audio objects and to a reconstructed residual signal corresponding to the residual signal;

generating a bitstream based on the SR downmix signal and the JOC parameters; and inserting SR metadata indicative of a format and/or of a number of channels of the SR input signal into the bitstream.

2. The method of claim 1, wherein the method comprises waveform coding of the downmix signal to provide downmix data; and the bitstream is generated based on the downmix data.

3. The method of claim 1, wherein the JOC parameters, comprise:

upmix data enabling the upmixing of the SR downmix signal to the one or more reconstructed audio objects and to the reconstructed residual signal; and/or decorrelation data enabling a reconstruction of a covariance of the one or more audio objects and of the residual signal.

4. The method of claim 1, wherein the method further comprises:

transforming the object signals of the one or more audio objects into a subband domain to provide a plurality of subband signals for each of the object signals; and determining the JOC parameters based on the plurality of subband signals of the object signals.

5. The method of claim 1, wherein:

the residual signal comprises a multi-channel audio signal and/or a bed of audio signals; and/or the residual signal comprises a plurality of audio objects at fixed object locations; and/or the residual signal comprises a first-order ambisonics signal.

6. The method of claim 1, wherein the method further comprises:

transforming the SR input signal into a subband domain to provide a plurality of SR subband signals for a plurality of different subbands;

determining a plurality of dominant directions of arrival for the corresponding plurality of SR subband signals;

clustering the plurality of dominant directions of arrival to n clustered directions of arrival, with n>0; and extracting n audio objects based on the n clustered directions of arrival.

7. The method of claim 6, wherein the method further comprises:

mapping the SR input signal onto the n clustered directions of arrival to determine the object signals for the n audio objects; and/or determining the object metadata for the n audio objects using the n clustered directions of arrival.

8. The method of claim 6, wherein the method further comprises:

within each of the plurality of SR subbands, subtracting subband signals for the object signals of the n audio objects from the SR subband signals, to provide a plurality of residual subband signals for the plurality of subbands; and determining the residual signal based on the plurality of residual subband signals.

9. The method of claim 1, wherein:

downmixing the SR input signal comprises selecting a subset of the plurality of channels of the SR input signal for the SR downmix signal; and/or the SR input signal is an $L^{th}$ order ambisonics signal, with L>1, and the SR downmix signal is an ambisonics signal of an order lower than L.

10. The method of claim 1, wherein:

the plurality of different directivity patterns of the plurality of channels of the SR input signal are arranged in a plurality of different rings of a sphere around the reference position;

the different rings exhibit different elevation angles;

different directions of arrival on the same ring exhibit different azimuth angles; and different directions of arrival on the same ring are uniformly distributed on the ring.

11. The method of claim 1, wherein:

the SR input signal comprises an L-order ambisonics signal, with L greater than or equal to 1;

the SR input signal exhibits a beehive format with the plurality of directivity patterns being arranged in a plurality of different rings around the reference position; and the SR input signal exhibits an intermediate spatial format (ISF).

12. The method of claim 1, wherein each channel of the SR input signal comprises a sequence of audio samples for a sequence of frames.

13. The method of claim 1, wherein:

the bitstream uses an AC-4 syntax; and the bitstream is generated based on an encoding compliant with a standard selected from: the AC-4 standard, the MPEG AAC standard, the Enhanced Voice Services, referred to as EVS, standard, and the HE-AAC standard.

14. A method for decoding a bitstream indicative of a soundfield representation (SR) of an SR, input signal describing a soundfield at a reference position, wherein the SR input signal comprises a plurality of channels for a plurality of different directivity patterns of the soundfield at the reference position, the bitstream comprising downmix data indicative of a reconstructed downmix signal and joint object coding (JOC) parameters parameters, the method comprising:

upmixing the reconstructed downmix signal using the JOC parameters to derive one or more reconstructed audio objects and a reconstructed residual signal, wherein an audio object comprises an object signal and object metadata indicating a position of the audio object;

deriving SR metadata indicative of at least a format and a number of channels of the SR input signal from the bitstream; and determining a reconstructed SR signal of the SR input signal based on the one or more reconstructed audio objects, based on the reconstructed residual signal and based on the SR metadata.

15. The method of claim 14, further comprising:

transforming the object signals of the one or more reconstructed audio objects into a QMF domain or a FFT-based transform domain;

transforming the reconstructed residual signal into the subband domain; and determining the reconstructed SR signal of the SR input signal based on the subband signals of the object signals and of the reconstructed residual signal within the QMF domain or the FFT-based transform domain.

16. The method of claim 14, wherein the method further comprises:

transforming the reconstructed downmix signal into a QMF domain or a FFT-based transform domain, to provide a plurality of downmix subband signals; and upmixing the plurality of downmix subband signals using the JOC parameters to provide the one or more reconstructed audio objects or the reconstructed residual signal.

17. The method of claim 14, wherein:

the reconstructed residual signal is an SR signal comprising less channels than a reconstructed SR signal of the SR input signal; and the method comprises upmixing the reconstructed residual signal to the number of channels of the reconstructed SR signal.

18. The method of claim 14, wherein the method comprises rendering the one or more reconstructed audio objects and/or the reconstructed residual signal or a reconstructed SR signal derived therefrom.

19. The method of claim 14, wherein:

the bitstream uses an AC-4 syntax; and the bitstream is compliant with a standard selected from: the AC-4 standard, the MPEG AAC standard, the Enhanced Voice Services, referred to as EVS, standard, and the HE-AAC standard.

20. An encoding device configured to encode a soundfield representation (SR) input signal describing a soundfield at a reference position, wherein the SR input signal comprises a plurality of channels for a plurality of different directivity patterns of the soundfield at the reference position wherein the encoding device comprises:

one or more processors configured to:

extract one or more audio objects from the SR input signal, wherein an audio object comprises an object signal and object metadata indicating a position of the audio object;

determine a residual signal based on the SR input signal and based on the one or more audio objects;

downmix the SR input signal to a SR downmix signal;

perform joint object coding (JOC) of the one or more audio objects and the residual signal to determine JOC parameters for enabling upmixing of the SR downmix signal to one or more reconstructed audio objects corresponding to the one or more audio objects and to a reconstructed residual signal corresponding to the residual signal; and generate a bitstream based on the SR downmix signal and the JOC parameters, wherein SR metadata indicative of a format and number of channels of the SR input signals is inserted into the bitstream-.

21. A decoding device configured to decode a bitstream indicative of a soundfield representation (SR) input signal describing a soundfield at a reference position, wherein the SR input signal comprises a plurality of channels for a plurality of different directivity patterns of the soundfield at the reference position, the bitstream comprising downmix data indicative of a reconstructed downmix signal and joint object coding (JOC) parameters, wherein the decoding device comprises:

one or more processors configured to:

upmix the reconstructed downmix signal using the JOC parameters to derive one or more reconstructed audio objects and a reconstructed residual signal, wherein an audio object comprises an object signal and object metadata indicating a position of the audio object;

derive SR metadata indicative of a format and/or a number of channels of the SR input signal from the bitstream; and determine a reconstructed SR signal of the SR input signal based on the one or more reconstructed audio objects, based on the reconstructed residual signal and based on the SR metadata.

* * * * *